United States Patent [19]

Skalleberg

[11] Patent Number: 4,848,697

[45] Date of Patent: Jul. 18, 1989

[54] ARM FOR CABLE WINDING

[75] Inventor: Oystein Skalleberg, Vallingby, Sweden

[73] Assignee: Skaltek AB, Kungsägen, Sweden

[21] Appl. No.: 112,545

[22] Filed: Oct. 26, 1987

Related U.S. Application Data

[63] Continuation-in-part of Ser. No. 856,458, Apr. 25, 1986.

[51] Int. Cl.[4] ..... B65H 54/28; B65H 57/28

[52] U.S. Cl. ..... 242/158 R; 242/157.1

[58] Field of Search ..... 242/158 R, 158 B, 158 F, 242/158.2, 158.3, 158.4 R, 158.4 A, 158.5, 157 R, 157.1, 54 R

[56] References Cited

U.S. PATENT DOCUMENTS

| | | | |
|---|---|---|---|
| 2,141,934 | 12/1938 | Pierson . | |
| 2,926,001 | 2/1960 | Mack et al. | 242/157 R X |
| 2,972,855 | 2/1961 | Holm | 242/158.5 X |
| 3,118,627 | 1/1964 | Nelson et al. | 242/158.2 X |
| 3,270,982 | 9/1966 | Prange | 242/158.3 |
| 3,400,901 | 9/1968 | Parilla et al. | 242/158 R |
| 3,514,048 | 5/1970 | Lowery | 242/157 R |
| 3,670,988 | 6/1972 | Leonard | 242/158 R |
| 3,687,385 | 8/1972 | Skalleberg | 242/158.4 |
| 4,068,705 | 1/1978 | Cofer et al. | 242/157 R X |
| 4,098,468 | 7/1978 | Skalleberg | 242/54 R |
| 4,143,834 | 3/1979 | Hara et al. | 242/158 R |
| 4,260,119 | 4/1981 | Price | 242/157 R |
| 4,371,308 | 2/1983 | Skalleberg | 414/416 |
| 4,421,284 | 12/1983 | Pan | 242/158 R |

FOREIGN PATENT DOCUMENTS

| | | | |
|---|---|---|---|
| 1014891 | 8/1957 | Fed. Rep. of Germany | 242/158 R |
| 2603861 | 8/1977 | Fed. Rep. of Germany . | |
| 2914625 | 10/1980 | Fed. Rep. of Germany . | |
| 2357462 | 2/1978 | France . | |
| 2464218 | 4/1981 | France | 242/158 R |
| 2065181 | 6/1981 | United Kingdom . | |

*Primary Examiner*—Stanley N. Gilreath

*Attorney, Agent, or Firm*—McAulay Fisher Nissen & Goldberg

[57] ABSTRACT

Apparatus for guiding the winding of a line such as an electric cable onto a drum having a central axis. The guiding apparatus is positioned in front of the drum in the winding position thereof, and the drum has a winding action and a reciprocatory movement imparted thereto parallel to and relative to the axis of the drum. The guiding apparatus includes a joint coupled with a stand, a resiliently deflectable guiding arm having one end pivotable about the joint, and a guide mechanism arranged along the arm for guiding the conveyance of the cable. The cable extends in contact with the guide mechanism and along the arm and has an advancing speed of conveyance equal to or less than the drum winding speed. The resiliently deflectable guiding arm is resiliently deflectable in a plane at a right angle to the central axis of the reel.

14 Claims, 3 Drawing Sheets

A-A

ARM FOR CABLE WINDING

This application is a continuation-in-part of application Ser. No. 856,458, filed on Apr. 25, 1986.

BACKGROUND OF THE INVENTION

1. Field of the Invention

The present invention relates to an apparatus for guiding the winding of a line, preferably an electric cable, onto a reel, cable drum, or the like.

More specifically, the invention is concerned with an apparatus for winding a line in the form of an electric or other type of a comparatively heavy cable onto a cable drum or reel. During a winding operation, the apparatus is given reciprocatory movement parallel and relative to the drum or reel axis.

2. Description of the Prior Art

In winding a line or cable onto a reel or drum, the line comes from a machine which advances the line with a substantially constant speed, or from a storage reel or other storage means. Devices are generally provided to advance the lines. During winding, the line runs through a guide which usually includes two rollers mounted on vertical shafts for guiding the cable laterally. These guide rollers may be adjustable for different cable cross sections and have the facility of moving apart with a spring bias to allow the passage of joints, knots and similar portions of the line having greater cross section. In spite of the aforesaid spring bias of the guide rollers, irregularities in the line can easily bend or destroy the guiding process. During winding, the guide mechanism may either be given a reciprocatory movement parallel to the reel axis, the position of the reel being stationary, or the winding mechanism imparts to the reel a reciprocatory movement parallel to the reel axis, in which case the guide mechanism remains stationary. The stroke of the reciprocatory movement corresponds in both cases to the axial length of the reel so that the cable is wound uniformly across the axial length of the reel.

The reel is usually arranged on a winding means which lifts the reel and gives it a rotating movement. The rotational speed of the reel is adjusted so that a predetermined tension is obtained on the cable. Simultaneously, as reel rotation starts from one end wall, there is provided movement of the reel parallel to the axis thereof at a speed corresponding to the width of the line per turn of the reel. When the line arrives at the other end wall of the reel, the movement parallel to the axis is reversed.

The manufacture of an electric cable is usually divided into a plurality of steps. In one such step, the cable is unwound from a reel, passed through a machine which carries out the manufacturing operation, and is then wound onto a reel by a special winding machine. In such manufacturing steps, tensions and jerks occur in the cable, due to different causes, which disturbs the manufacturing and winding processes.

The winding process is particularly jerky in its initial stages, since the reel rotation starts from a speed of zero. Such effects can also be obtained if the cable is wound from a storage reel on which the cable is unevenly wound, and the unwinding resistance suddenly decreases.

Uniform winding of the cable onto the reel, layer by layer, is necessary if the intended cable length is to be accommodated on the reel, and if the cable is to escape damage, as well as if unwinding is to take place as far as possible without jerks in the next manufacturing step.

It is normally very difficult to obtain an even and proper winding of a heavy cable onto a cable drum, since cables of this kind are stiff, unwieldy and cumbersome. For a user of these types of cables, it is, however, important that the cable be very properly wound onto the drum, without kinks and the like, as it is important for the user that the cable can be paid out evenly and without jerks from the drum. Jerks and other variations in tension may, for instance, occur when one or several turns have been wedged together tightly, due to an uneven winding of the cable onto the drum. These problems result from irregularities in the cable when it is wound onto the drum; for instance, lumps of plastics material emenating from the manufacturing process of the cable will stick to the cable. The entire winding apparatus is subjected to great forces when the cable is bent in accordance with the shape of the drum, and when each new turn is guided close to the adjacent, prior turn of the cable onto the drum due to the stiffness of the cable. It is furthermore important that the drum contain the exact amount of cable it is designed for, and this is not the case if there are any irregularities in the winding process.

An object of the invention is to provide a winding apparatus for winding heavy cable onto a cable drum which is not subjected to great forces from the cable during the winding process, and that furthermore ensures that the cable is evenly and properly wound, turn by turn, onto the drum, thus eliminating any kinks or other irregularities that may cause problems when the cable is paid out from the drum.

Another object of the invention is to provide a winding apparatus for heavy cable that allows an exact amount of a cable to be wound onto a cable drum.

A further object of the present invention is to provide guide apparatus which gives uniform and fault-free winding onto a reel and which counteracts the drawbacks described above.

By "resiliently deflectable" or "flexible and spring biassed", it is intended in accordance with the invention that, on the application of a force, an arm is flexed in a curve formed as a function of forces. When the magnitude of the force decreases, the arm returns towards its unaffected state. In the ideal case, the arm is given a deflection at every point along its length when the cable exercises a load or force onto the arm. Other preferred practical embodiments include a finite number of articulated links.

BRIEF DESCRIPTION OF THE INVENTIVE CONCEPT

The above and other objects are attained in an apparatus having a first stand provided with a mechanism or stand holding a drum to be rotated, and further including a non-driven cable guiding device to guide and provide for the conveyance of the cable to a drum mounted on the stand, and a mechanism for rotating the drum. The guiding device comprises a second stand, a guiding arm which is resiliently flexible along its operative length in a plane perpendicular to the axis of rotation of the drum. The arm is provided with a guiding mechanism in the form of an endless web or belt means or a plurality of guiding rollers, having obliquely oriented guiding surfaces for the cable. The guiding arm resiliently supports ad tensions the cable along the length of the guiding device, and either or both the drum and the guiding device is or are given a reciprocatory movement with respect to the other.

To these ends, the invention consists in the provision of an apparatus for guiding the winding of a line such as an electric cable onto a drum or reel having a central axis. The apparatus is positioned in front of the drum and proximate thereto in the winding position, and generally includes: a stand and a shaft coupled together, the drum having imparted thereto a reciprocatory movement parallel to the relative axis of the drum and a winding action; a resiliently deflectable guiding arm with one end of the guiding arm being pivotable about the shaft; a guide mechanism arranged along the arm for guiding the conveyance of the cable, the cable extending in contact with the guide and conveyor mechanism and along the arm and having an advancing speed of conveyance imparted thereto by the drum equal to or less than the drum winding speed; and the resiliently deflectable arm is resiliently deflectable in a plane at a right angle to the central axis of the reel.

As noted heretofore, "resiliently deflectable" or flexing and "spring-biassed" refers to the flexing of the arm in a curve as formed as a function of forces or the application of force.

The invention is also broadly concerned with an apparatus having a reel or drum onto which a cable is to be wound and for guiding the winding of the cable onto the drum. The apparatus includes: a stand and a shaft operatively associated with each other; a device for imparting a reciprocatory movement parallel to and relative to the axis of the drum, but being separate therefrom, an arm having one end rigidly fastened with the shaft; guide means to permit conveyance of the cable operatively associated with and arranged along the arm and with the cable extending in contact with the guide means and along the arm, and wherein a portion of the arm is resiliently deflectable in a plane at right angles to the axis of the drum.

The guide means includes guide rollers each having two different portions arranged on two sides of the cable. The axes of the guide rollers are substantially at right angles to the direction of movement of the cable towards the reel.

Prior art has been cited in the parent application, noted above, of which this application is a continuation-in-part, and such prior art are U.S Pat. Nos. 2,926,001 of February 1960, 3,118,627 of January 1964, 3,270,982 of September 1966, 3,400,901 of September 1968, 3,514,048 of May 1970, 3,670,988 of June 1972, 3,687,385 of August 1972, 4,068,705 of January 1978 and 4,260,119 of April 1981; German Pat. No. 1,014,891 of August 1957; and French Pat. No. 2,464,218 of April 1981; and such prior art is useful to disclose the background operational and structural features, such as the reciprocating movement which does not form a specific movel feature of this invention, and all such prior art is incorporated by reference to show those elements of the apparatus of the invention considered to be conventional structure.

DETAILED DESCRIPTION OF THE PREFERRED EMBODIMENTS OF THE INVENTION

Figure 1:
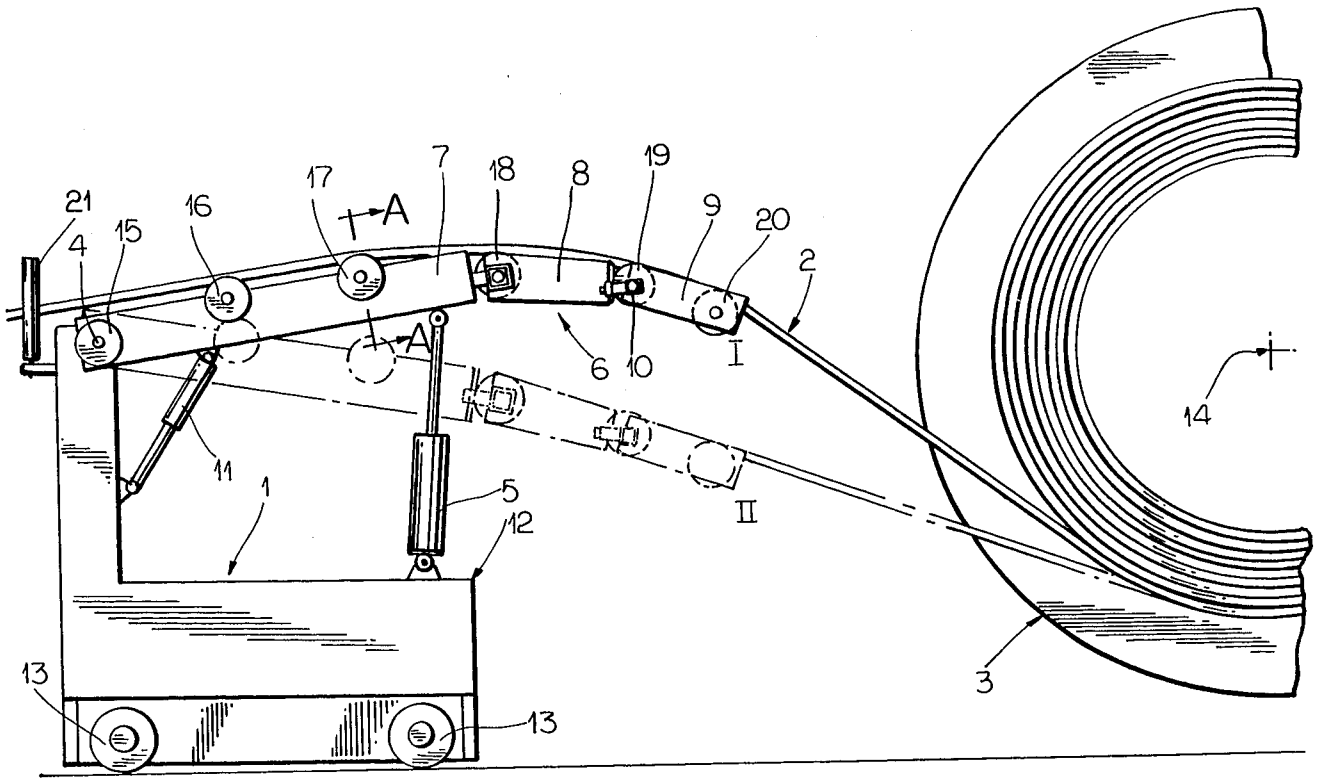
FIG. 1 shows a side view of a first preferred embodiment of the invention.

FIG. 1 shows an apparatus for winding a line or cable 2 onto a drum 3 together with a cable guiding device 1 for guiding the cable 2 onto the drum. Cable 2 is fed to drum 3 with a more or less constant feeding speed from a typical storage means or storage drum not forming part of the invention, and thus is not illustrated. Drum 3 is mounted in a typical winding apparatus in which the drum is lifted and given a rotation by an appropriate driving means. The rotational speed, and thus the winding speed, can be adjusted to be somewhat greater than the feeding speed of the cable, by which means the cable will have a certain, predetermined tension. Simultaneously with the rotation of the drum, the drum 3 is given a reciprocatory movement that is parallel to the rotational axis of the drum 3. The reciprocatory movement is of a speed corresponding to the width of the cable for each turn of the drum. When an end wall of the drum 3 reaches a portion of the cable not yet wound and which laterally is more or less stationary in space, this movement that is parallel to the rotational axis 14 of the cable drum 3 is reversed. In effect, it is like a pendulum which goes through a zero velocity when changing directions.

The apparatus for winding the cable is not shown, and only a part of the drum 3 onto which the cable is wound is indicated in a section at right angles to its axis 14.

The device for guiding the cable onto the drum comprises a stand 12 to which a guiding arm 6 is articulately joined at one end by means of a joint 4. Arm 6 and joint 4 have a common axis around which the arm is journalled to joint 4. Arm 6 further comprises a first link 7, a second link 8 and a third link 9, which are connected to each other by means of a joint 10; and joint 10 includes resilient spring means. The joint 10 between links 8 and 9 is the same as the undesignated joint between links 7 and 8. The first link 7 is resiliently supported on the stand by both spring means 5 and damping means 11, both schematically shown. Spring means 5 is preferably a pneumatically or hydraulically controlled piston-cylinder means, the stroke end and springing action of which are freely adjustable. Adjustment, for instance, can be a function of one or more of the weight of the cable, the diameter of the drum or of the amount of cable wound onto the drum, i.e., the instantaneous diameter of the drum. The link 7 will swing against the action of spring means 5, depending on variations of tension in cable 2. The swinging movement of the link 7 is further damped by the damping means 11 that, for instance, can be a spring or a piston-cylinder means.

Arm 6 in addition to being swingable around the axis in joint 4 is also resiliently flexible along its length because of the action of the spring means in joint 10. Each of these spring means comprises two coaxially arranged tubes which are quadrangular in cross-section and are rotated to some extent in relation to each other. The tubes are separated from each other by rubber cushions filling the triangular spaces formed between the tubes, so that torsional spring elements are formed in joints 4 and 10. The joints 4 and 10, as well as the different spring and damping means acting on and in arm 6, all are arranged in a way that the swinging and flexing movement of the arm 6 takes place in a plane that is perpendicular to the axis of rotation of the cable drum.

Figure 2:
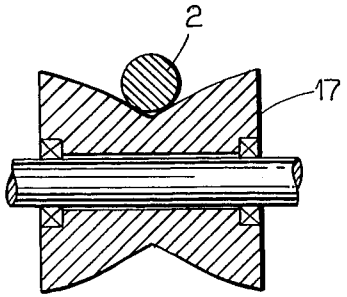
FIG. 2 is a sectional view taken along line A—A in FIG. 1.

On the upper side of arm 6, the guiding mechanism is arranged in the form of a plurality of rollers 15, 16, 17, 18, 19 and 20 arranged along the entire length of the arm 6 for guiding and permitting the cable to be conveyed to the drum. These rollers are non-driven, and their lateral guiding surfaces are preferably V-shaped, as can best be seen in FIG. 2. A suitable and preferred angle for the V-shape is 120°.

Stand 12 further includes wheels 13 by the means of which the distance between the stand and drum 3 can be adjusted, and thus, also the distance of arm 6 from the drum can also be optionally adjusted. Stand 12 also includes guide rollers 21 located at or before the beginning of the arm 6 proximate to joint 4 and serves to guide the cable onto the guiding and rollers 15, 16, 17, 18, 19 and 20. When fully loaded, the arm assumes the position indicated by chain-dotted lines, while the guiding mechanism for the cable is illustrated as the plurality of horizontal rollers 15, 16, 17, 18, 19 and 20 on which the cable runs and is in contact with the envelope surface of the rollers during winding for guiding and facilitating movement of the cable.

OPERATION OF THE FIG. 1 APPARATUS

Drum 3 is moved a distance laterally along its axis of rotation 14 in direct correspondence to the width of the cable 2 for each turn of the drum 3, which means that the free edge of the cable layer being wound will seem to be stationary. Guiding device 1, while it is provided with wheels 13, is in principle also laterally stationary in this embodiment so that only the drum is movable transversely to the direction of movement of the drum along its own axis. The end of the arm 6 closest to the cable drum 3 can be located at a constant distance away from drum 3, or in contact with or almost in contact with drum 3. In this latter case, arm 6, of course, has to be distanced from the rotational axis 14 of drum 3 during the winding procedures in accordance with the amount of cable wound onto the drum. Cable 2 is fed from a storage drum or another storage means with a substantially constant speed.

During the winding process, the tension of the cable is predetermined by the feeding speed from the storage drum and by the speed with which the cable is wound onto the drum.

At the start, the end of the cable is led through the guide rollers 21 over the guiding mechanism formed by rollers 15–20 on the upper side of arm 6 to the cable drum. During the initial stage, when the rotation of the drum is started, the drum does not and is not able to wind the cable with the feeding speed from the storage drum, and the tension in the cable 2 will therefore be small. As a consequence of this, the load on arm 6 will be comparatively low, and arm 6 will move towards the position indicated by Roman numeral I in FIG. 1. However, before arm 6 actually reaches the full outline position shown by I, drum 3 will reach such a rotational speed that the winding speed is equal to or exceeds the cable feeding speed. The tension of the cable and, thus, also the resistance of the cable against winding, will then exceed a predetermined value, so that the motive force on the drum is counteracted. Due to the inertia of the system, the winding speed will only be slowly reduced, with the consequence that the arm 6 is forced downwardly, towards the position shown in broken line outline designated by Roman numeral II. In this way, a damped swinging process into a stationary condition is obtained, during which process the arm 6 swings and flexes vertically and thus keeps the cable constantly corrected tensioned. As can be seen in FIG. 1, arm 6 assumes an arcuate shape due to the fact that it is vertically flexible. As discussed above, the winding apparatus moves the drum 3 laterally simultaneously with the rotation of the drum; the axial movement of the drum is reversed when the cable contacts one of the side walls of the drum. Simultaneously with the reversal of this lateral movement, device 1 may, if necessary, be made to move away from the drum if the arm is to be in contact with the drum or the cable turns on the drum, otherwise the device 1 is stationary.

In this embodiment, winding of the cable is carried out with the drum rotating counter-clockwise. This winding can, of course, also be carried out clockwise. Device 1, as shown in FIG. 1, is positioned on the ground, but it can also be arranged on a plinth, so that the device is located at a higher level relative to the drum 3 than the level shown.

SECOND EMBODIMENT

Figure 3:
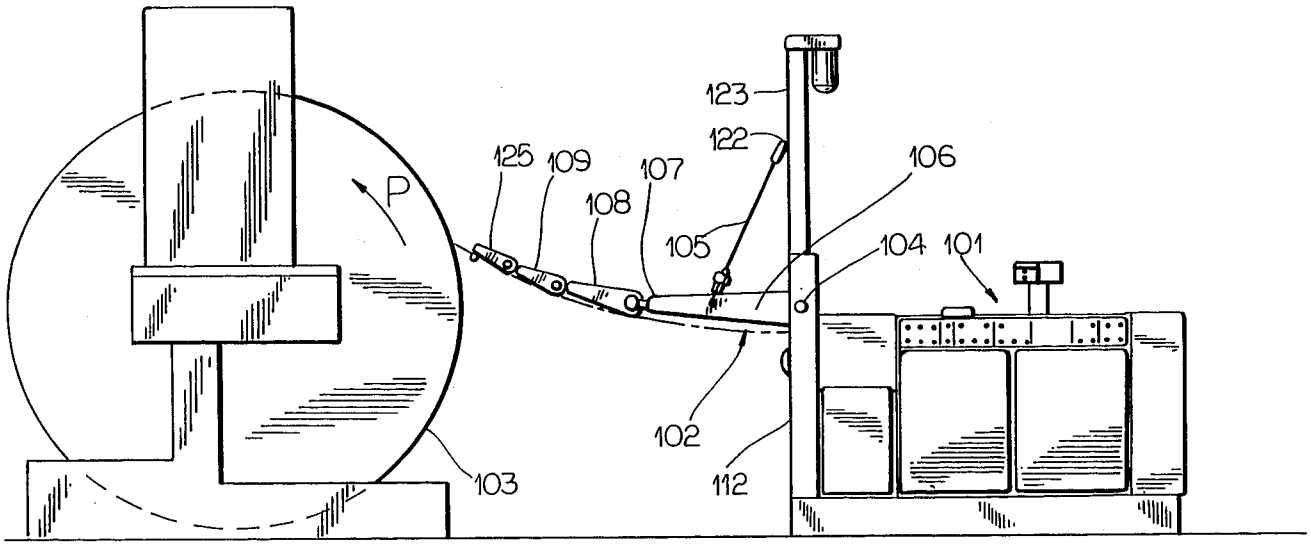
FIG. 3 is a side view of a second embodiment of the invention and also includes a measuring and cutting station; the cable extends under the underside of the arm.

FIG. 3 shows a second preferred, somewhat modified embodiment of the invention. This device also includes a stand 112 which is provided with wheels, in a manner similar to the FIG. 1 embodiment, but not readily visible in FIG. 3, to adjust the distance between guiding device 101 and drum 103. Guiding device 101 includes an arm 106 which is swingably journalled around a joint 104, generally shown as a shaft. Arm 106 is provided with a guiding mechanism which also acts as a conveying mechanism because of the rollers which are not illustrated here; and these rollers are of the same kind as those described and shown in connection with the devices according to FIGS. 1 and 2. Cable 102 which is indicated with dash-and-dot lines is guided along the underside of the arm. The arm 106 is carried by a spring means 105, that may be of the same kind as the spring means 5 shown in FIG. 1. The spring means 105 is at its one end attached to the arm 106 and, at its other end 122, spring means 105 is attached in the stand 112. End 122 of the spring means 105 which is attached to stand 112 is adjustable with respect to the height relative to the ground or the distance to the joint 104. This adjustment may either be carried out in that the upper part 123 of stand 112 is vertically adjustable, or in that the attachment point 122 of spring means 105 is movable vertically, for instance by means of a jack mechanism or a screw and nut mechanism. The arm 106 is similar to arm 6 shown in FIG. 1, and is composed by links 107, 108, 109 and 125.

SENSING MEANS

Figure 4:
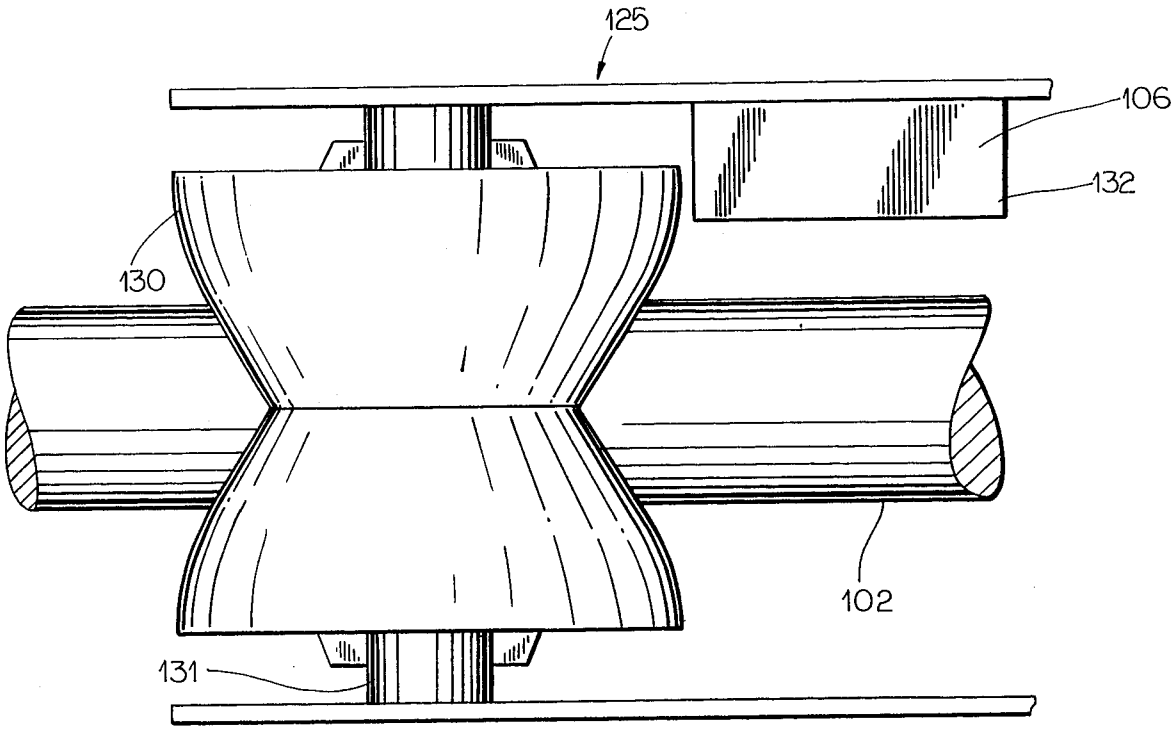
FIG. 4 is a detail of the guiding arm and is a detailed feature of the invention.

FIG. 4 illustrates how a sensing means for sensing a possible lateral displacement of the outermost guiding roller can be arranged at the tip of the arm. In this Figure, a part of link 125 is shown as seen from above with a front roller 130, which on its underside supports cable 102. Roller 130 is journalled on a shaft 131 and has a smaller lateral extent than the length of shaft 131 and the distance between the two link plates 125, which means that roller 130 is movable axially. Sensing means 132 is mounted on arm 106 for sensing the position of roller 130 along shaft 131.

In the normal case, i.e., when the drum 103 is in such a position that the cable is in the vertical plane of the guiding means when wound from arm 106 onto drum 103, roller 130 will be located at the center of the shaft 131. If, however, drum 103 is moved faster or slower laterally than the ideal lateral movement, the part of the cable 102 located between arm 106 and the drum wheel will form an angle with the vertical plane through the guiding means, and consequently, roller 130 will be moved laterally from its center position on the shaft 131 towards the right or the left. This movement or displacement is sensed by sensing means 132, which by means of a connection between sensing means 132 and the driving unit for the lateral movement of the drum, sends a signal to the driving unit to correct the position of the cable drum 103 and, in effect, also imparts a lateral displacement to the cable drum.

The flexible characteristics of the arm will ensure that any variations in tension in the cable will be smoothly compensated in a way that, for instance, would not be possible with a rigid arm, merely being swingable against the action of the spring means. The oblique orientation of the guiding surfaces of the guiding means will ensure that any irregularities or lumps on the cable simply will be moved away from the apex of the "V" formed by the guiding surfaces instead of being caught and held between the surfaces and thus giving rise to undesirable variations in tension or jerks in the cable.

The essential characteristics of the invention will thus ensure that the guiding device is not subjected to great forces while still safeguarding an even and smooth winding. One important consequence of this is that the guiding device according to the invention can be designed to be very light and with slender and thin dimensions. Another important consequence is that the guiding device normally does not need to be fixedly attached to the ground but can be designed to be movable, and that consequently, one guiding device can be used, in turn, for several drums.

POSSIBLE MODIFICATIONS OF THE INVENTION

The device according to the invention can, of course, be modified in many ways within the scope of the disclosure. Thus, for instance, with regard to the illustrated first embodiment, one of either the spring means 5 or the damping means 11 can be omitted. It is also conceivable to replace either of the spring means 5 or the damping means 11, or possibly both, with a spring means located in joint 4; this replacement spring means in joint 4 may suitably be a torsion spring. It is furthermore conceivable to attach the first link 7 rigidly to the stand 12, the resilient flexing of the arm in this case solely being performed by means of joints 10 between the outermost links of the arm and the spring means located within the joints 10. In the illustrated, preferred embodiments, the flexible characteristics of the arm has been obtained in that the arm 106 is composed of a number of links articulately joined to each other and in combination with differing spring means, which means that arm 6 or 106 in each of the embodiments is flexible at a number of discrete points. In the ideal case, however, the arm in the guiding means is resiliently flexible in every point along its length, which would be the case if the arm, for instance, consists of an integral, resiliently flexible, tapering rod.

In the above, illustrated embodiments, the cable drum has been shown to be laterally movable in relation to a guiding device which is stationary in principle. It is, however, within the scope of the invention, quite possible to design the cable drum to be laterally stationary while still being rotatable and to design the guiding device 1 so that it is laterally movable relative to the drum along an axis and parallel to the drum axis, but spaced therefrom, or to design both as being simultaneously laterally movable relative to each other.

An endless web or belt means can optionally be used as the guiding and conveying mechanism instead of the guide rollers, this belt means should preferably also be provided with guide surfaces which are obliquely oriented in a V-shape.

The axis of rotation of the drum has been illustrated as being oriented horizontally, but this axis can, of course, be oriented in any desired direction since the cable will be kept on the guiding and conveying mechanism by means of the guiding surfaces in conjunction with the predetermined tension in the cable irrespective of the orientation of the plane of movement of the guiding arm.

As noted heretofore, various changes and modifications may be made without departing from the scope of the invention.

I claim:

1. An apparatus for use in a reciprocating relationship with a drivable drum and for guiding the winding of a line such as an electric cable onto the drum, said drum having a central axis, the apparatus being positioned in front of the drum and proximate thereto in a winding position, said apparatus comprising:

a stand and a joint coupled with said stand;

a resiliently deflectable guiding arm, one end of said arm being pivotable about said joint;

guide means arranged along said arm for guiding the conveyance of the cable, the cable extending in contact with said guide means and along said arm;

said resiliently deflectable guiding arm being resiliently deflectable in a plane at a right angle to the central axis of the drum; and said arm being positioned just to touch the cable for guiding thereof onto the drum, and said arm including at least two adjacent links mutually relatively movable; and means, including articulated joints uniting said adjacent links, and said articulated joints including spring element means counteracting the deflection of said arm.

2. Apparatus as claimed in claim 1, including spring means associated with said stand, one end of said spring means being attached to said stand and said arm being carried by and attached to the other end of said spring means.

3. Apparatus as claimed in claim 1, including damping means having one end connected to one of said two adjacent links and the other end connected with said stand, one end of one of said adjacent links being pivotable about a shaft associated with said stand.

4. Apparatus as claimed in claim 1, including spring means having one end connected to one of said two adjacent links and another end connected with said stand.

5. Apparatus as claimed in claim 1, wherein said guide means includes guide rollers for guiding the cable associated with said stand the axes of said guide rollers being substantially at right angles to the direction of movement towards said drum for guiding the forward end of the cable, and winding means operatively associated with said drum for rotation thereof to take up the cable.

6. Apparatus as claimed in claim 1, including a roller in contact with said cable and having an axis perpendicular to said plane in which said arm is resiliently deflectable.

7. Apparatus as claimed in claim 6, wherein the circular surface of the rollers is V-shaped, with an angle of 120°.

8. Apparatus for use with a drum onto which a cable is to be wound and means for guiding the winding of the cable onto said drum, said drum having a central axis about which said drum rotates, said guiding means comprising:

a stand and a shaft operatively associated with said stand;

an arm having one end rigidly fastened with said shaft; and guide means operatively associated with and arranged along said arm, said cable extending in contact with said guide means and along said arm; and said arm including:

a portion thereof being resiliently deflectable in a plane at right angles to the axis of said drum;

said arm being positioned to just touch the cable for guiding thereof onto the drum and including adjacent links connected together with articulation means to provide for movement of said links relative to each other when a load is applied to said arm which produces a possible deflecting at substantially every point along its length when the cable imparts a load onto said arm.

9. Apparatus as claimed in claim 8, including:

spring means and damping means;

said spring means having one end carrying one end of said arm, and the other end of said spring means being articulated to said stand; and said damping means having one end connected to said arm and its other end articulated to said stand.

10. Apparatus as claimed in claim 8, wherein said guide means includes guide rollers each having V-shaped portions arranged on two portions of the side of the cable, the axes of said guide rollers being substantially at right angles to the direction of movement of the cable towards said reel.

11. Apparatus as claimed in claim 10, wherein the outwardly facing surface of the rollers is provided with a V-shaped groove therein with an angle of 120°.

12. Apparatus as claimed in claim 8, including spring means supporting said shaft on said stand, said spring means including means for adjusting the force thereof.

13. Apparatus as claimed in claim 8, including:

spring means having one end carrying one end of said arm, means for adjusting the force of said spring means, said other end of said spring means being carried by said stand and being displaceable relative to a fastening position of said arm; and the other end of said spring means being carried by said stand.

14. Apparatus as claimed in claim 8, wherein said articulation means includes:

at least two mutually relatively movable adjacent individual links;

articulated joints coupled with each of said two adjacent individual links for uniting said adjacent links together; and spring elements in said articulated links counteracting the deflection of aid arm in said plane;

at least one of said spring means and said damping means being connected to one of said adjacent links;

at least one of said spring means said damping means being rigidly fastened to said one of said adjacent links; and said conveyor means comprising journalled rollers, said rollers having an outer grooved V-shaped surface, with an angle of 120°.

* * * * *